US006088931A

United States Patent [19]

Aylor et al.

[11] Patent Number: 6,088,931

[45] Date of Patent: Jul. 18, 2000

[54] INTERSTATION INFRARED HEATING UNIT

[75] Inventors: John E. Aylor, Ft. Worth; Brian K. Totten, Euless; Michael R. Ocker, Garland, all of Tex.

[73] Assignee: Howard W. DeMoore, Dallas, Tex.

[21] Appl. No.: 09/240,789

[22] Filed: Jan. 27, 1999

Related U.S. Application Data

[60] Provisional application No. 60/072,777, Jan. 27, 1998.

[51] Int. Cl.[7] ..... F26B 3/34

[52] U.S. Cl. ..... 34/267; 34/269; 34/274; 34/555; 34/649; 34/655

[58] Field of Search ..... 34/266, 267, 269, 34/273, 274, 549, 555, 629, 649, 655; 392/379, 380, 407, 423; 101/230, 232, 409, 410, 420, 424.1; 347/102, 101

[56] References Cited

U.S. PATENT DOCUMENTS

| | | | |
|---|---|---|---|
| 3,900,959 | 8/1975 | Breschi et al. . | |
| 4,257,172 | 3/1981 | Townsend . | |
| 4,434,562 | 3/1984 | Bubley et al. . | |
| 4,596,935 | 6/1986 | Lumpp . | |
| 4,798,007 | 1/1989 | Eichenlaub . | |
| 4,798,960 | 1/1989 | Keller . | |
| 4,809,608 | 3/1989 | Wolnick . | |
| 4,811,493 | 3/1989 | Burgio, Jr. . | |
| 4,876,436 | 10/1989 | Ide et al. . | |
| 4,882,852 | 11/1989 | Kautto . | |
| 4,882,992 | 11/1989 | Schmoeger . | |
| 4,989,343 | 2/1991 | Ericsson . | |
| 5,010,659 | 4/1991 | Treleven | 34/649 |
| 5,092,059 | 3/1992 | Wimberger et al. | 34/641 |
| 5,099,586 | 3/1992 | Anderson . | |
| 5,142,795 | 9/1992 | Abbott . | |
| 5,168,811 | 12/1992 | Cox et al. . | |
| 5,369,894 | 12/1994 | Schaffer et al. . | |
| 5,440,821 | 8/1995 | Hamrin . | |
| 5,502,788 | 3/1996 | Platsch . | |
| 5,537,925 | 7/1996 | Secor . | |
| 5,754,208 | 5/1998 | Szlucha | 347/102 |
| 5,787,810 | 9/1998 | Stephan | 101/232 |
| 5,813,134 | 9/1998 | Min et al. | 34/255 |
| 5,991,506 | 11/1999 | Platsch | 392/379 |

*Primary Examiner*—Stephen Gravini
*Attorney, Agent, or Firm*—Locke Liddell & Sapp, LLP

[57] ABSTRACT

A dryer is disclosed in a compact design for interstation use on printing presses, particularly lithographic presses. High velocity air is combined with intense infrared radiation to heat, evaporate and scrub vapor from freshly printed substrates. Air under pressure is provided through passages in a housing which is passed toward and by the infrared lamp in such a way as to cool the lamp and thereafter impact the substrate being dried. A pressure sensing control prevents operation of the lamp without the cooling air. The lamp power circuit is switched off if air pressure is lost. The dryer is mounted in an extractor housing provided with a negative pressure to extract the supplied air after it impacts upon the substrate.

9 Claims, 5 Drawing Sheets

INTERSTATION INFRARED HEATING UNIT

CROSS REFERENCE TO RELATED APPLICATION

This is a continuation application of U.S. patent application Ser. No. 60/072,777 entitled as above which was filed on Jan. 27, 1998, for which benefit of filing date is requested.

FIELD OF THE INVENTION

The invention relates to an improved device for interstation drying of freshly printed substrates in a printing press.

BACKGROUND OF THE INVENTION

In the operation of a rotary offset press, an image is reproduced on a sheet of paper or some other print stock by a plate cylinder which carries the image, a blanket cylinder which has an ink transfer surface for receiving the inked image, and an impression cylinder which presses the paper against the blanket cylinder so that the inked image is transferred to the paper. In some applications, a protective and/or decorative coating is applied to the surface of the freshly printed sheets. The freshly printed sheets are then conveyed to a sheet delivery stacker in which the finally printed sheets are collected and stacked.

In many instances printing liquids applied at an intermediate printing station of a multi-stand printing press use water as a solvent, dilutent or vehicle. These may be applied as images, spot coatings or overall coatings prior to subsequent in-line lithographic printing. If too much water remains on the printed substrate, problems with delayed drying and image quality can occur because moisture inhibits drying of ink. The problems are exacerbated as press speed is increased.

The wet ink and coatings should be dried before the sheets are stacked or run back through the press for a second pass, to prevent smearing defects and to prevent offsetting of the ink on the unprinted side of the sheets as they are stacked. Spray powder has been applied between the freshly printed sheets which are to be stacked to improve sheet handling and to separate one delivered sheet from the next sheet to prevent offsetting while the ink and/or coating dries. One limitation of the use of spray powder is that fugitive particles of the spray powder disperse into the press room and collect on press equipment, causing electrical and mechanical breakdowns and imposing a potential health hazard for press room personnel.

DESCRIPTION OF THE PRIOR ART

Hot air convection heaters and radiant heaters have been employed to reduce the volume of spray powder applied, except for the small amount needed for sheet handling purposes. Hot air convection heaters are best suited for slow to moderate speed press runs in which the exposure time of each printed sheet to the hot air convection flow is long enough that aqueous base inks and coatings are set before the sheets reach the stacker.

For high-speed press operation, for example, at 5,000 sheets per hour or more, the exposure time of each printed sheet as it passes through the dryer station is not sufficient to obtain good drying by convection flow alone. Radiant heaters such as infra-red heat lamps provide greater drying efficiency because the short wave length infra-red energy is preferentially absorbed in the liquid inks and coatings to provide rapid evaporation. The infra-red radiant energy releases water and volatiles from the ink and/or coating.

Consequently, a humid air layer clings to the printed surface of the sheet as it moves through the dryer, and will be trapped between adjacent sheets in the stack unless it is removed.

As press speed is increased, the exposure time (the length of time that printed sheet is exposed to the radiant heat) is reduced. Consequently, the output power of the radiant lamp dryers has been increased to deliver more radiant energy to the printed sheets in an effort to compensate for the reduction in exposure time.

The higher operating temperatures of the high-powered lamps cause significant heat transfer to the associated printing unit, coater and press frame equipment, accelerated wear of bearings and alterations in the viscosities of the ink and coating, as well as upsetting the water balance of aqueous coatings. The heat build-up may also cause operator discomfort and injury.

SUMMARY OF THE INVENTION

In accordance with one aspect of the present invention, a fast medium wave infrared dryer is provided. The dryer preferably operates at a lamp bulb temperature of about 1600°–1800°F. The lamp is mounted in a housing which has a row or rows of air passages for cooling of the lamp and housing. The cooling air is blown past the lamp onto freshly processed substrates to aid in drying. The combination of intense infrared radiation and high velocity air to scrub the surface of substrate passing under the working face of the dryer enhances drying. The housing and/or the lamp preferably includes reflectors having a highly reflecting surface which is well suited for reflecting a high percentage of infrared radiation provided by the lamp and which is relatively immune to tarnishing at high temperature. The dryer includes a control system which monitors the presence of supply air pressure electrically connected in a circuit which controls the lamp. This permits the lamp to be turned off in the event there is a failure in the supply of cooling air, in order to prevent high temperature produced by the lamp from causing damage or implicating safety concerns. The dryer unit is a streamlined compact design well suited for fitting into the small space that is provided by press manufacturers between printing stations. The dryer is mounted within an extractor shell which pulls a vacuum to draw off the air which was blown past the lamp and provided by the working surface of the dryer and extracts that air after it impacts onto the freshly printed surface of a substrate.

DETAILED DESCRIPTION OF THE INVENTION

Figure 1:
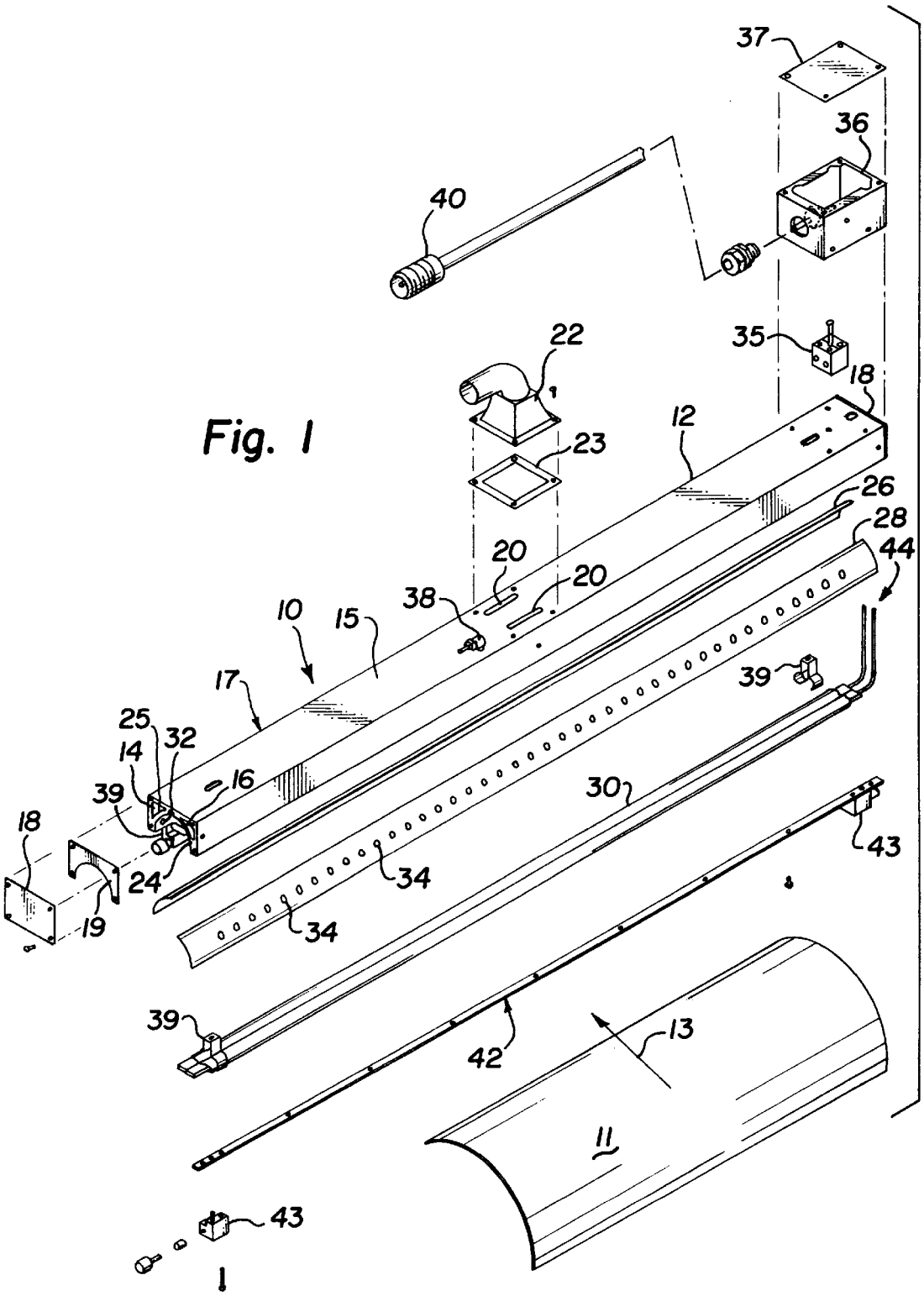
FIG. 1 is an exploded perspective view of a first embodiment of the invention showing its transverse relation to the path of the incoming freshly printed substrate.
Figure 2:
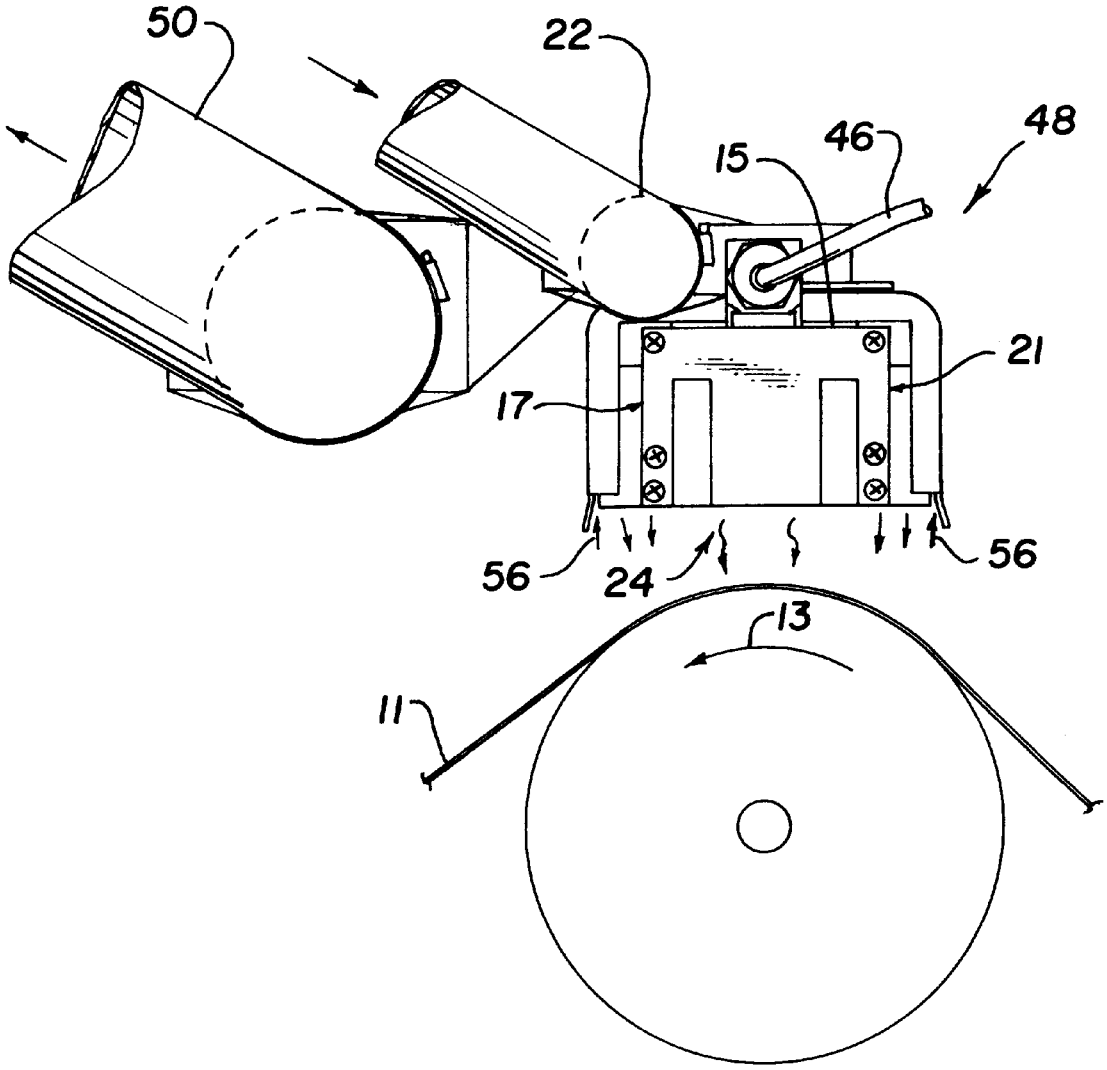
FIG. 2 is a schematic end elevation view of a preferred commercial embodiment of the first embodiment of FIG. 1 shown in relation to the path of freshly processed substrate.

In the description that follows, the same or similar reference numerals will be used to indicate the same or similar parts. With reference to FIG. 1, there is illustrated a dryer assembly forming a first embodiment of the present invention. Dryer 10 is used to dry ink or coating on a freshly processed (printed) substrate 11 as it passes under the dryer in the direction of arrow 13. A better view of this relationship in connection with the commercial embodiment (unit) of the first embodiment of FIG. 1 is shown in FIG. 2.

The dryer 10 includes an elongated dryer housing 12, preferably formed as an aluminum extrusion. This is considered an important feature because it is readily formed to contain continuous elongated cavities or passages for air and it has excellent heat transfer capacity. Elongated housing 12 preferably defines first and second cooling air passages denominated cooling air passages 14 and 16, best seen in FIGS. 1, 5 and 6, which run the length of elongated housing 12. End plates 18 and gaskets 19 close off the open ends of cooling air passages 14 and 16 at each end of housing 12. Although twin air cooling passages are shown, they could be combined into one elongated air cooling passage or be flow interconnected. More than two elongated cooling air passages should be considered within the scope of invention.

Figure 5:
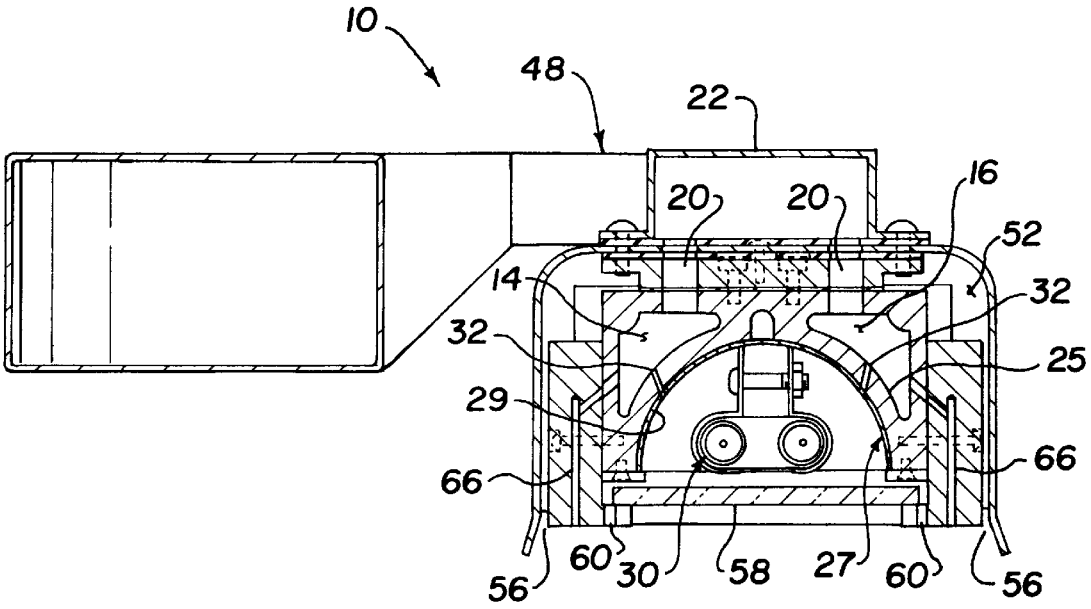
FIG. 5 is a transverse elevational section showing the commercial embodiment on the line 5—5 of FIG. 3.
Figure 6:
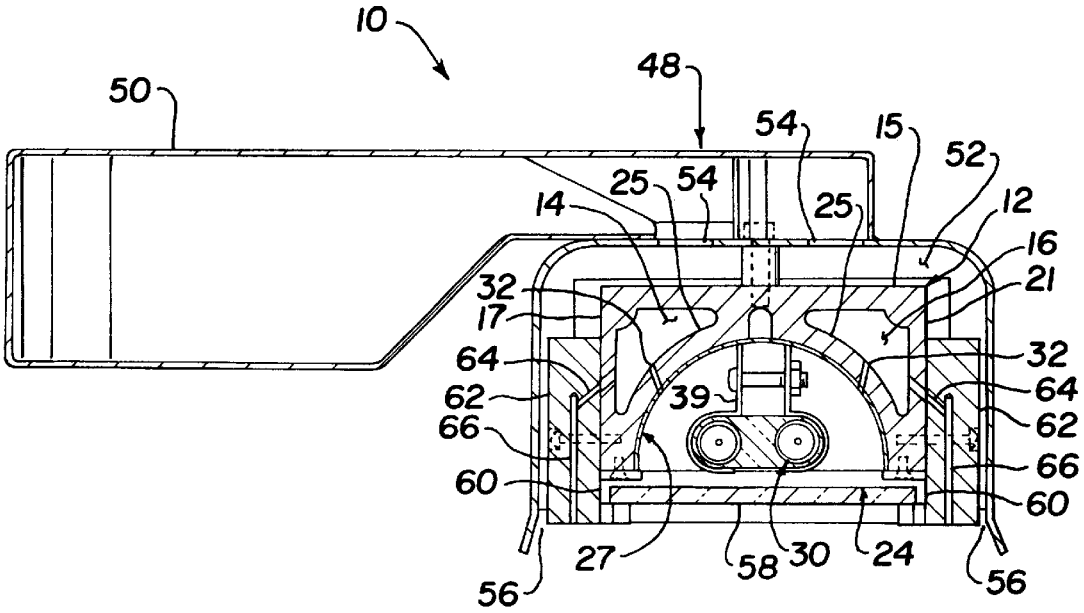
FIG. 6 is a transverse elevational section showing the commercial embodiment on the line 6—6 of FIG. 3.

Housing 12 has a back 15, a first side portion 17 and a second side portion 21, which are more or less shaped as three sides of a rectangular shape customary with extrusions. The elongated dryer housing can be said to have a working face 24 which in the operational orientation of the dryer as in FIGS. 1 and 2 is positioned just above the freshly printed substrate 11 passing under the dryer in the direction 13. The working face 24 is formed as a semi-cylindrical concave opening 24 bounded generally by the back 15 and side portions 17 and 21 on opposite sides of the working face and running the length of housing 12. A curved wall 25 is formed in the interior of elongated housing 12 in front of (below) back 15. Curved wall 25 partly defines air passages 14 and 16. Curved wall 25 has a curved outer surface 27 partly defining the concave opening 24. The working face can be considered to include an elongated infrared lamp 30 which is centrally positioned generally in the concave space 24 spaced below curved wall 25, preferably as shown in FIGS. 1, 5 and 6. Lamp 30 comprises a fast medium wave infrared lamp which preferably has two infrared bulbs as illustrated although the number and power is a matter of choice. The bulbs preferably operate at a temperature of about 1600°–1800° F. to provide the desired fast medium wave infrared radiation. One lamp that has been used in a unit constructed in accordance with the teachings of the present invention is manufactured by Heraeus as their 9698 436 model lamp. Heraeus model 53798 lamp has been selected for a commercial unit.

The curved outer surface 27 of curved wall 25 should be provided as a reflecting surface well suited to reflecting infrared radiation and capable of withstanding elevated temperatures in air generated by the infrared lamp 30 in close proximity to the reflecting surface. The most preferred reflective surface 29 that could be recommended for this purpose is gold as gold reflects around 98 percent of medium wave infrared radiation incident thereon. Gold does not tarnish, withstands heated air and as mentioned is an excellent reflector of infrared radiation. Gold plating has the disadvantage of increased cost.

A convenient implementation of a reflective surface has been accomplished by mounting first and second reflectors 26, 28 onto the curved outer surface 27 of curved wall 25 wherein the surface of reflectors 26 and 28 facing lamp 30 are highly polished aluminum. The Heraeus bulb used in the preferred embodiment commercial unit includes a curved reflector behind the filaments which is gold plated. Therefore a gold plated reflecting surface can be provided as part of the bulb package. Reflectors 26, 28 are provided with a row of openings 34 spaced along their length, which as will be seen, serve as exit ports for cooling air directed toward lamp 30 from air passages 14, 16. They are aligned with openings 32 into the air passages.

Figure 7:
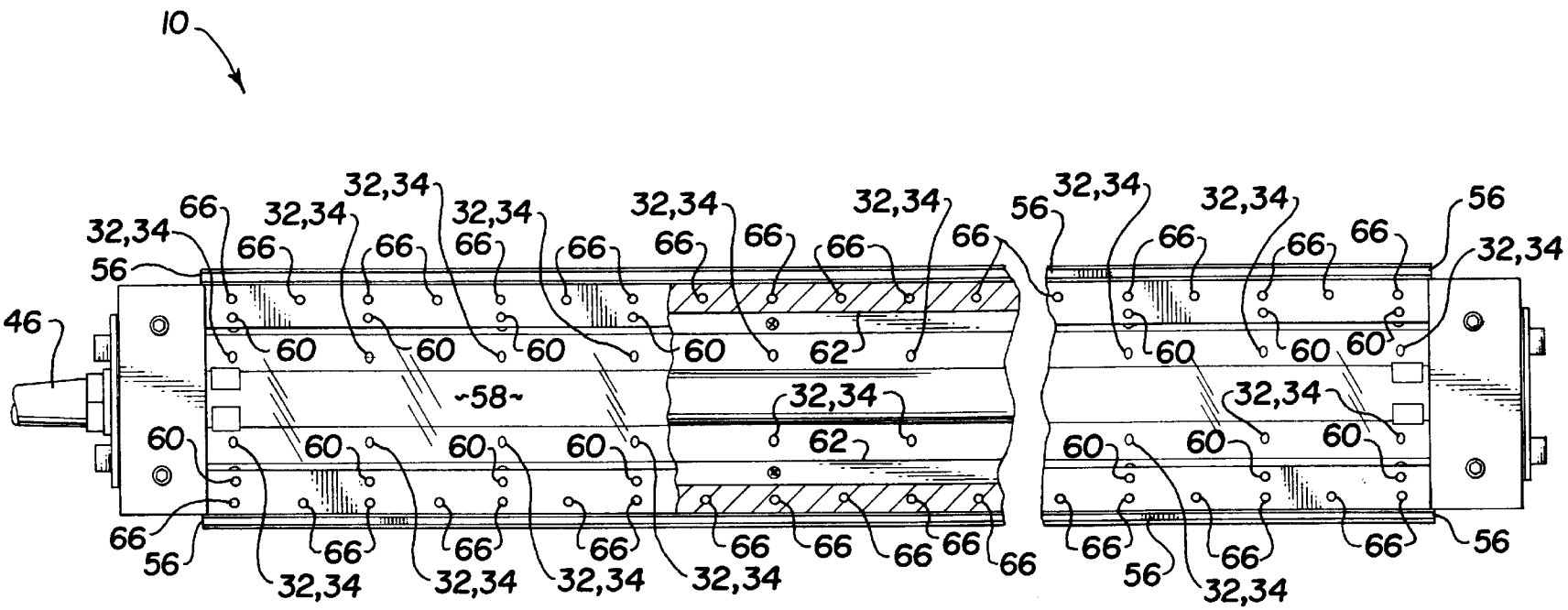
FIG. 7 is a bottom view of the preferred commercial embodiment of FIG. 2.

Referring now to FIGS. 1, 5, 6 and 7, housing 12 has two rows of spaced holes (openings) 32 running along curved wall 25 and fluidly connecting cooling air passages 14, 16 with working face 24 in front of the reflecting surface of wall 25. As seen in FIGS. 5, 6 and 7, air from passages 14, 16 within housing 12 is directed toward the bulbs for lamp 30 and passes by the lamp, cooling the lamp by picking up heat from the lamp and housing and becoming heated air in the exchange. In the commercial embodiment of FIGS. 2–7, the working face may be protected by a loosely mounted quartz lens 58 selected to pass most of the infrared radiation produced by lamp 30 on through it. The loose mounting takes account of thermal expansion. Passages 60 are provided on each side of lens 58 whereby the cooling air from openings 32, 34 escapes the working face and impinges the substrate 11. The commercial embodiment of FIG. 6 preferably also includes longitudinal side pieces 62 on each side which are fluidly connected to one of the air cooling passages 14, 16 by means of openings 64 and 66 which direct some of the air in passages 14 and 16 out onto the substrate 11 as additional high velocity air directed onto the surface of the substrate. This air picks up heat from the parts of housing 12 to raise the temperature of the air being deposited on the substrate and helps cool housing 12 as well. Heated air impacting the substrate 11 assists in drying the ink or coating by removing volatiles from it. The exact number and spacing of openings is a matter of choice and must be balanced with the incoming air supply so that there is sufficient pressure to produce high velocity air to impact the substrate. Good pressure has been provided on the sheet with an average air velocity of about 27–30 inches of water column. This may be varied depending upon press speeds, ink or coatings used and solvents, etc. The idea is to scrub the vapor being volatilized by the infrared radiation and heat so that it does not interfere with further drying and is not available to recondense on the sheet. Dryer 10 is housed within an extractor which extracts the air from the slots along the sides after it has impacted the surface of the substrate to assist drying of the ink or coating on the substrate. The air is extracted in a direction opposite the direction the drying air is moving when it contacts the substrate. Spent air is extracted from above the substrate.

Figure 3:
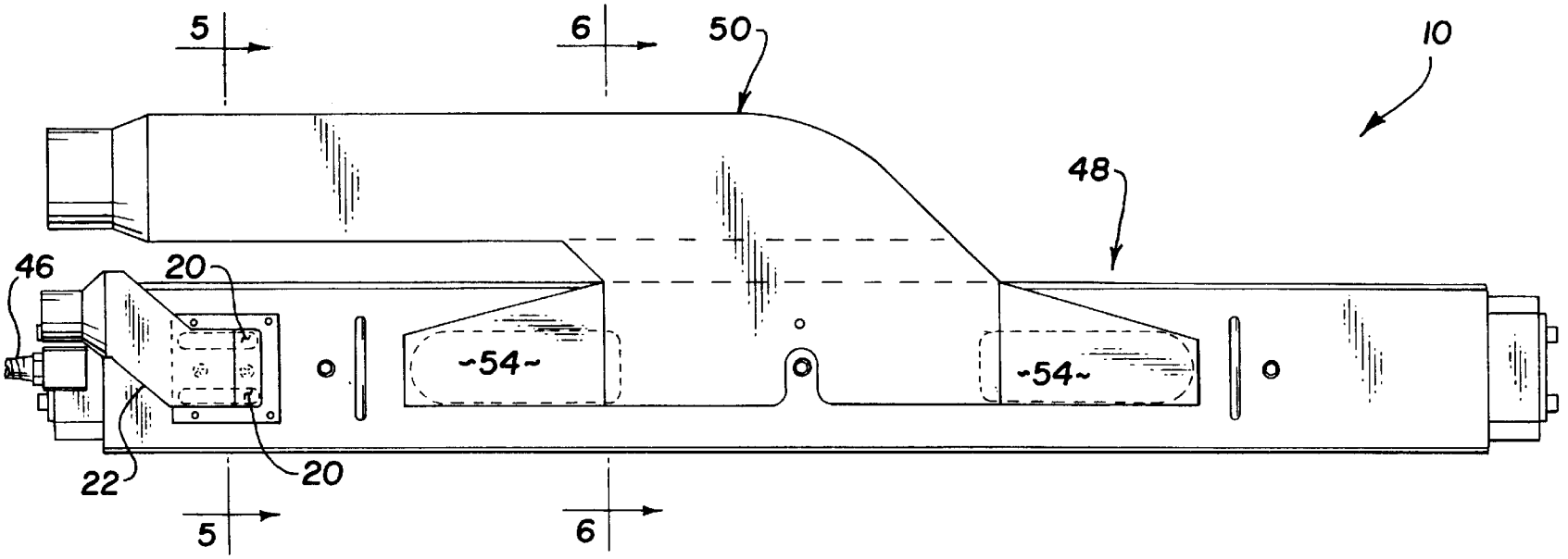
FIG. 3 is a schematic top plan view of the preferred commercial embodiment of FIG. 2.
Figure 4:
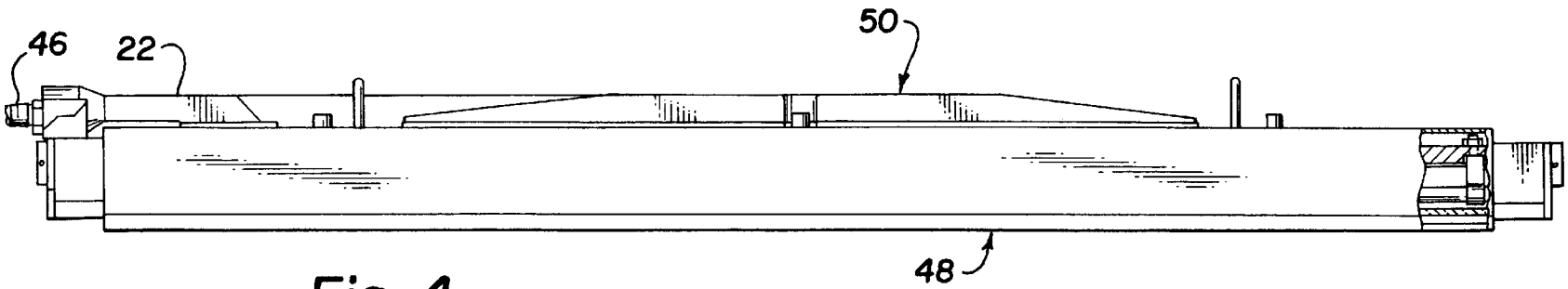
FIG. 4 is a partially cut-away side elevation of the commercial embodiment of FIG. 3.

In FIG. 1, air is supplied to housing 12 from supply duct 22 which is fastened to the back 15 of housing 12 over a pair of intake slots 20. Gasket 23 prevents air under pressure from escaping. In FIGS. 3 and 4, intake slots 20 are located closer to an end of the dryer and the intake shape is modified. It is attached to the housing 12 through the housing of the extractor. The area of intake slots 20 is preferably at least about twice the combined area of the holes in the housing 12 to insure a relatively high pressure air flow through the outlet holes that are present whereby the pressurized air is directed onto the substrate. This prevents slots 20 from becoming a restriction that builds up too much air pressure in the supply duct instead of pressurizing the air flow passages 14, 16.

Dryer 10 also has a control unit 36 which is connected by a connection piece 35 to housing 12 or mounted on an extractor in which housing 12 resides. Control unit 36 has cover 37 and an air pressure sensor 40 which senses air pressure from chamber 16 or chamber 14, as the case may be, which is delivered to the control unit by means of a nipple 38. Control unit 36 acts to shut down lamp 30 if no air pressure is sensed by sensor 40 from within cooling air passage 16 or 14. This is an important aspect of dryer 10 because the safe operation of the dryer depends in part in the cooling action of the air from passages 14 and 16 upon lamp 30. These lamps operate at around 5000 to 6000 watts at 480 volts in an exemplary embodiment having twin filaments about 43 inches long (1100 mm). Without good air flow, the dryer will overheat and may overheat and damage adjacent press parts. Lamp 30 is supported spaced apart from the curved outer surface of curved wall 25 by means of standoffs 39. Lamp 30 may be supported in housing 12 by a support strip 42 and mounting clamps 43 which comprise a support assembly. Power connector leads 44 are schematically shown in FIG. 1. Power supply connector 46 shown in the other Figures is connected to leads 44 to provide power for the twin bulbs of lamp 30.

The dryer 10 is preferably part of an extractor. In FIGS. 2–7 the housing 12 is mounted in an extractor housing 48. Extractor housing 48 has the air inlet 22 in FIG. 5 which delivers pressurized air through slots 20 into the respective air cooling passages 14 and 16. Air cooling passages 14, 16 are shown to be separated but could be in fluid flow connection inside housing 12 if desired to promote more uniform air pressure. Air passages 14, 16 could also be a single cooling air passage behind curved wall 25.

In the extractor 48, a relative vacuum is maintained to draw in the air which has passed through the air flow openings in housing 12 after it has impacted on the substrate to assist drying and for disposal away from the press to a remote area. The extracted air moves in the reverse direction as compared to the applied high velocity air as shown in FIG. 2. The combination of air flow and infrared radiation promotes rapid drying of the freshly printed substrate 11. Housing 48 further includes vacuum outlet 50 which is connected to a space 52 through suction openings 54 in FIG. 6. Space 52 within housing 48 leads to suction inlets 56 in the form of slots running the length of dryer housing 12 along the outside edge portions 17 and 21. Vacuum is preferably provided by the suction of a blower.

One significant advantage of the dryer 10 is that it is so compact that it can be installed between printing units of a press as well as at the delivery end of the press. The working face of dryer 10 is preferably positioned within the printing press so that the lamp is only about one and one half to about two inches from the substrate being dried. In tests using a dryer of the type described, speeds of 10,000 impressions per hour have been possible with adequate drying.

In the best mode an exemplary commercial unit includes 33 nozzles in the protective glass area and 66 nozzles outside the protective glass area wherein the nozzle diameters in both cases have a diameter of about 0.09 inches. Air exit velocity has been measured from the nozzles at about 342 feet per second at one pound per square inch exit pressure. A bulb manufactured by Heraeus has a lamp specification of 6,000 watts which operates at 480 volts. In a test of a commercial unit, a stack of sheets could be run back through the press after waiting for about 2 hours instead of the 4 hours normally allowed for curing of lithographic inks. In some cases, printing could be accomplished in a second pass right after the first pass was completed. The extractor should extract as much or more air than is being supplied by the dryer and the air is preferably filtered. The bulb is preferably tied to the operation of the press so that when the press stops the bulb is turned off and turned on again when the press is restarted.

Those skilled in the art will appreciate that various modifications to the method and apparatus of the present invention may be made without departing from the scope of invention as defined in the appended claims.

What is claimed:

1. An infrared high velocity air dryer for interstation use, comprising:

an elongated dryer housing having a front working face positionable above freshly printed substrate passing under the dryer;

the elongated housing having a back, behind the front working face and side portions comprising first and second side portions on opposite sides of the working face;

an elongated air passage running substantially the length of the housing behind the working face, the elongated air passage being partly defined by a curved wall having a row of spaced apart air openings along the curved wall and a curved outer surface partly defining the working face;

the curved outer surface being a reflecting surface well suited to reflecting infrared radiation and withstanding elevated temperatures generated by an infrared bulb in close proximity to the reflecting surface;

the working surface comprising the reflecting surface and an elongated infrared bulb mounted just in front of the reflective surface and running along the length of the reflecting surface;

an air supply inlet for supplying high velocity air to the working face through the elongated air passage and a row of air openings in the elongated air passage by which high velocity air is directed toward the lamp; and wherein high velocity air is heated as it cools the lamp and together with infrared energy may be delivered by the working face to a freshly printed substrate.

2. The infrared high velocity air dryer of claim 1 wherein the dryer further comprises a control unit equipped with a sensor responsive to pressure which acts to shut down the lamp if no air is being supplied to the elongated air passage.

3. The infrared high velocity air dryer of claim 2 wherein said elongated dryer housing is mounted within an extractor housing of an extractor portion of the dryer which extracts air and volatiles after heated air from the working face has impacted the surface of the substrate.

4. The infrared high velocity air dryer of claim 3 wherein the air delivered to a substrate by the working face is applied in one general direction and extracted by the extraction in an opposite general direction.

5. The infrared high velocity air dryer of one of claims 1, 2 or 3 wherein a reflecting surface comprising a gold plated surface is provided.

6. The infrared high velocity air dryer of one of claims 1, 2 or 3 wherein the reflecting surface comprises a curved reflector which is attached to the curved outer surface of the working face.

7. The infrared high velocity air dryer of claim 6 wherein the infrared radiation produced by the bulb is reflected toward said substrate from a gold plated reflecting surface.

8. The infrared high velocity air dryer of one of claims 1, 2 or 3 in combination with a freshly printed substrate wherein the working face is so positioned that its lamp lies about 1 to 1½ inches from the surface of the substrate.

9. The infrared high velocity air dryer of one of claims 1, 2 or 3 wherein the ratio of the area of the air supply inlet to the combined area of the row of air openings in the housing which deliver high velocity air is about at least two to one or more.

* * * * *